US006459800B1

(12) United States Patent
Brimhall

(10) Patent No.: US 6,459,800 B1
(45) Date of Patent: Oct. 1, 2002

(54) MODULAR HEARING DEVICE RECEIVER SUSPENSION

(75) Inventor: Owen D. Brimhall, South Jordan, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 0 days.

(21) Appl. No.: 09/614,066

(22) Filed: Jul. 11, 2000

(51) Int. Cl.[7] ..... H04R 25/00

(52) U.S. Cl. ..... 381/324; 181/171; 181/172; 381/322; 381/328; 381/329

(58) Field of Search ..... 381/322, 324, 381/328, 329, 304, 305; 181/171, 172

(56) References Cited

U.S. PATENT DOCUMENTS

| | | | | | |
|---|---|---|---|---|---|
| 2,678,645 | A | | 5/1954 | Raimo | 128/9 |
| 3,665,122 | A | | 5/1972 | Weiss | 179/107 |
| 3,783,201 | A | * | 1/1974 | Weiss | |
| 4,375,016 | A | | 2/1983 | Harada | 179/182 |
| 4,440,982 | A | * | 4/1984 | Kaanders | |
| 4,553,627 | A | | 11/1985 | Gastmeier et al. | 181/135 |
| 4,567,881 | A | | 2/1986 | Heller | 128/9 |
| 4,569,812 | A | | 2/1986 | Werwath et al. | 264/222 |
| 4,617,429 | A | * | 10/1986 | Bellfiore | |
| 4,756,312 | A | | 7/1988 | Epley | 128/420.5 |
| 4,852,177 | A | | 7/1989 | Ambrose | 381/154 |
| 4,854,415 | A | * | 8/1989 | Goshke | |
| 4,869,339 | A | | 9/1989 | Barton | 181/130 |
| 4,870,688 | A | * | 9/1989 | Voroba | |
| 4,879,750 | A | | 11/1989 | Nassler | 381/68.6 |
| 4,880,076 | A | | 11/1989 | Ahlberg et al. | 181/130 |
| 4,937,876 | A | | 6/1990 | Biërmans | 381/68.6 |
| 5,002,151 | A | | 3/1991 | Oliveira et al. | 181/130 |
| 5,031,219 | A | | 7/1991 | Ward et al. | 381/68.6 |
| 5,084,224 | A | | 1/1992 | Watters | 264/155 |
| 5,099,947 | A | | 3/1992 | Guggenberger et al. | 181/130 |
| 5,105,904 | A | | 4/1992 | Olsen | 181/128 |
| 5,166,659 | A | | 11/1992 | Navarro | 381/68.6 |
| 5,201,007 | A | | 4/1993 | Ward et al. | 381/68.6 |
| 5,203,352 | A | | 4/1993 | Gardner, Jr. | 128/864 |
| 5,293,008 | A | | 3/1994 | Danielsen | 181/135 |
| 5,327,500 | A | | 7/1994 | Campbell | 381/68.6 |
| 5,395,168 | A | | 3/1995 | Leenen | 381/68.6 |
| 5,401,920 | A | | 3/1995 | Oliveira | 181/135 |
| 5,440,082 | A | | 8/1995 | Claes | 181/135 |
| 5,654,530 | A | | 8/1997 | Sauer et al. | 181/130 |
| 5,682,020 | A | | 10/1997 | Oliveira | 181/130 |
| 5,701,348 | A | | 12/1997 | Shennib et al. | 381/68.6 |
| 5,748,743 | A | | 5/1998 | Weeks | 381/68.6 |
| 5,825,896 | A | | 10/1998 | Leedom | 381/69 |
| 5,881,159 | A | | 3/1999 | Aceti et al. | 381/328 |
| 5,887,070 | A | * | 3/1999 | Iseberg | |
| 5,920,636 | A | | 7/1999 | Oliveira et al. | 381/328 |
| 5,979,589 | A | | 11/1999 | Aceti | 181/135 |
| 5,996,584 | A | | 12/1999 | Oliveira et al. | 128/864 |
| 6,179,085 | B1 | * | 1/2001 | Brimhall | |

FOREIGN PATENT DOCUMENTS

| | | | |
|---|---|---|---|
| DE | 43 39 899 | 6/1995 | H04R/25/02 |
| EP | 0 367 855 | 5/1990 | A61B/1/22 |
| WO | WO 99/13686 | 3/1999 | H04R/25/02 |

* cited by examiner

*Primary Examiner*—Curtis Kuntz
*Assistant Examiner*—Dionne Harvey
(74) *Attorney, Agent, or Firm*—Lyon & Lyon LLP

(57) ABSTRACT

A receiver suspension for isolating a hearing device receiver within a hearing device comprises a housing that defines a chamber. The housing is adapted to be inserted into a hearing device shell. The receiver suspension also comprises a cover that is adapted to engage with a proximal end of the housing. An isolation membrane at least partially surrounds the hearing device receiver such that, upon inserting the hearing device receiver into the housing, the isolation membrane suspends the receiver within the housing chamber, thus preventing the receiver from contacting the inside surface of the housing. Preferably, the isolation membrane is formed from a stretched polymer material such as polyurethane or silicone and forms a series of pleats when engaged with the receiver. Alternately, the receiver suspension includes an isolation spring having two grasping members interconnected with a flexure member.

6 Claims, 4 Drawing Sheets

MODULAR HEARING DEVICE RECEIVER SUSPENSION

FIELD OF THE INVENTION

The present invention pertains to hearing aids. More particularly, the present invention pertains to suspension devices for hearing aid receivers.

BACKGROUND OF THE INVENTION

The modem trend in the design and implementation of hearing devices is focusing to a large extent on reducing the physical size of the hearing device. Miniaturization of hearing device components is becoming increasingly feasible with rapid technological advances in the fields of power supplies, sound processing electronics and micromechanics. The demand for smaller and less conspicuous hearing devices continues to increase as a larger portion of our population ages and faces hearing loss. Those who face hearing loss also encounter the accompanying desire to avoid the stigma and self consciousness associated with this condition. As a result, smaller hearing devices, which are cosmetically less visible, but more sophisticated, are increasingly sought after.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices rarely use this Behind-The-Ear technique, focusing primarily on one of several forms of an In-The-Canal hearing device. Three main types of In-The-Canal hearing devices are routinely offered by audiologists and physicians. In-The-Ear (ITE) devices rest primarily in the concha of the ear and have the disadvantages of being fairly conspicuous to a bystander and relatively bulky and uncomfortable to wear. Smaller In-The-Canal (ITC) devices fit partially in the concha and partially in the ear canal and are less visible, but still leave a substantial portion of the hearing device exposed. Recently, Completely-In-The-Canal (CIC) hearing devices have come into greater use. As the name implicates, these devices fit deep within the ear canal and are essentially hidden from view from the outside.

In addition to the obvious cosmetic advantages these types of in-the-canal devices provide, they also have several performance advantages that larger, externally mounted devices do not offer. Placing the hearing device deep within the ear canal and close to the tympanic membrane (ear drum) improves the frequency response of the device, reduces distortion due to jaw extrusion, reduces the occurrence of occlusion effects and improves overall sound fidelity. Earlier generation hearing devices function primarily by sound amplification and are typically not altered to a user's particular hearing impairment. Modern electronics allow specific sound processing schemes to be incorporated into the hearing device. Similarly, custom programming can be incorporated into the hearing device circuitry allowing a truly custom device for any particular user.

While the performance of CIC hearing devices are generally superior to other larger and less sophisticated devices, several problems remain. Complications typically arise due to the small size of CIC hearing devices and the depth that they are inserted into a user's ear canal. Additionally, the small size of the device, combined with increasingly complex electronics present other performance problems such as increased sensitivity to vibrations, more delicate components because of their small size, and the accompanying possibility of device failure.

The quality of the microphone system that receives sound waves is also critical to the performance of the hearing device. In general, hearing aids are configured with a microphone and a receiver (speaker) connected by an electronic circuit. The microphone picks up vibrational energy, i.e. sound waves, from the air or from the physical connection to the hearing aid. The physical connections can include the points where the hearing device shell and conducting wires join the receiver. A hearing device microphone transduces the sound waves into an electrical signal. The receiver (or speaker) then transduces the amplified electrical signal from the microphone and from any type of programming circuitry into vibrational energy which is then heard by a user. When driven by an electronic signal, the receiver itself will vibrate. Vibrations are also generated from within a user's own skull. If the receiver is in contact with another hearing device component, these vibrations will be transferred from the receiver to the component, and from the component to the microphone. This often causes unwanted feedback. Typically this contact with other components occurs at the receiver port area, where the amplified sound exits the hearing device. This unwanted contact can also occur between a receiver wall and the hearing aid shell.

A known approach in larger hearing devices is to try and suspend the receiver away from the hearing device shell. However, in smaller hearing aids it is difficult to do this reliably. Receivers are typically suspended by means of two functional elements, the first being a piece of tubing connected to a port on the end of the receiver, and the second being an elastomeric sleeve about the body of the receiver can. The tubing and the sleeve can be configured as two components or integrated into a single piece suspension. In the single piece version, the tubing is molded as a unit with the sleeve about the receiver body. Non-woven fabric tapes are also commonly used to isolate the receiver from the shell wall.

Additionally, known receiver suspensions are typically made from a low durometer rubber such a silicone and neoprene. These devices are often molded with small bumps or flanges that help to reduce the contact area between the suspension and a shell wall. However, these molded suspensions present problems. First, since the hearing aid shell on custom hearing aids vary greatly from device to device, this often defeats the effectiveness of the small flanged features on the molded tips. This is due to contact between the shell and the receiver along larger surface areas or due to wedging the rubber suspensions too tightly along a shell wall.

Second, the elastomeric suspensions are generally glued into place in the hearing aid shell, or the receiver port. This glue can wick along the materials and harden the otherwise compliant materials, thus defeating the purpose of utilizing a receiver suspension. Also the molded suspensions are relatively large due to limitations in molding technology, the wire coming from the receiver can interfere with the suspension, and the wire attached to the receiver can contact the receiver and shell in uncontrolled ways thereby further contributing to feedback problems. Furthermore, lower durometer suspension tubes are delicate and susceptible to failure due to mechanical ingress caused by cleaning and probing, providing a direct ingress path for cerumen and other contaminates. Finally, silicone suspension tubes are very difficult to glue and attach because silicone compatible adhesives are generally slow to cure.

What is needed is a simple way of suspending the receiver away from the wall of the hearing aid shell without the addition of a large suspension apparatus. What is also needed is a receiver suspension that allows quick and simple installation and is essentially universal for a wide range of hearing devices.

SUMMARY OF THE INVENTION

A receiver suspension for isolating a hearing device receiver within a hearing device shell comprises a housing having an inside surface that defines a chamber, an open proximal end, and a distal end. The housing is adapted to be inserted into the hearing device shell. The receiver suspension also comprises a cover that is adapted to engage with the proximal end of the housing. An isolation membrane at least partially surrounds the hearing device receiver such that, upon insertion of the hearing device receiver into the housing, the isolation membrane suspends the receiver within the housing chamber. The isolation membrane prevents the receiver from contacting the inside surface of the housing. Preferably, the isolation membrane is formed from a stretched polymer material such as polyurethane or silicone and forms a series of pleats when engaged with the receiver.

In an alternate embodiment, a receiver suspension comprises a housing having an inside surface that defines a chamber, an open proximal end, and a distal end. The housing is adapted to be inserted into a hearing device shell. The receiver suspension also comprises a cover that is adapted to engage with the proximal end of the housing. An isolation spring is adapted to engage the hearing device receiver such that upon insertion of the hearing device receiver into the housing, the isolation spring suspends the receiver within the housing chamber. The isolation membrane prevents the receiver from contacting the inside surface of the housing. Preferably, the isolation spring comprises first and second grasping members and a flexure member intermediate to and connected with the first and second grasping members. The flexure member preferably includes a pair of spring biased portions that maintain the receiver at a specified distance from the inside surface of the receiver housing. The receiver suspension can alternately be formed from a multi-layered laminate material that provides frequency response dampening.

BRIEF DESCRIPTION OF THE DRAWINGS

The drawings illustrate both the design and utility of the preferred embodiments of the present invention, in which similar elements in different embodiments are referred to by the same reference numbers for purposes of ease in illustration of the invention, wherein.

DETAILED DESCRIPTION OF THE PREFERRED EMBODIMENTS

Figure 1:
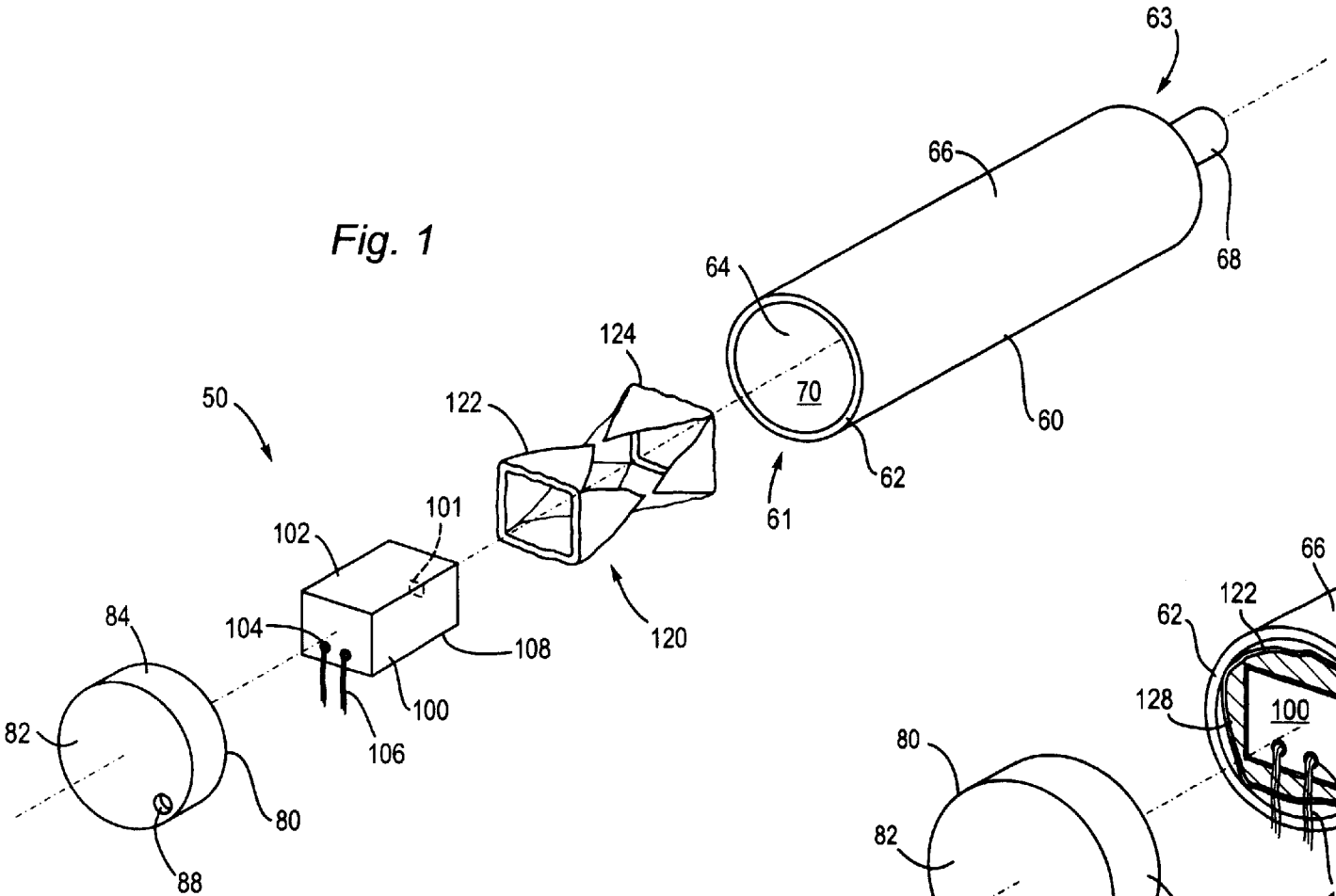
FIG. 1 is an exploded perspective view of a receiver suspension constructed in accordance with the present invention.
Figure 2:
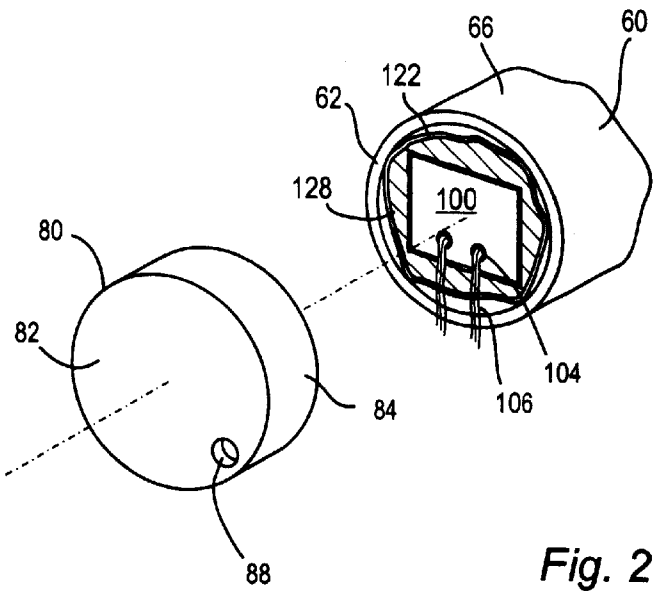
FIG. 2 is a partially assembled view of the receiver suspension of FIG. 1.
Figure 3:
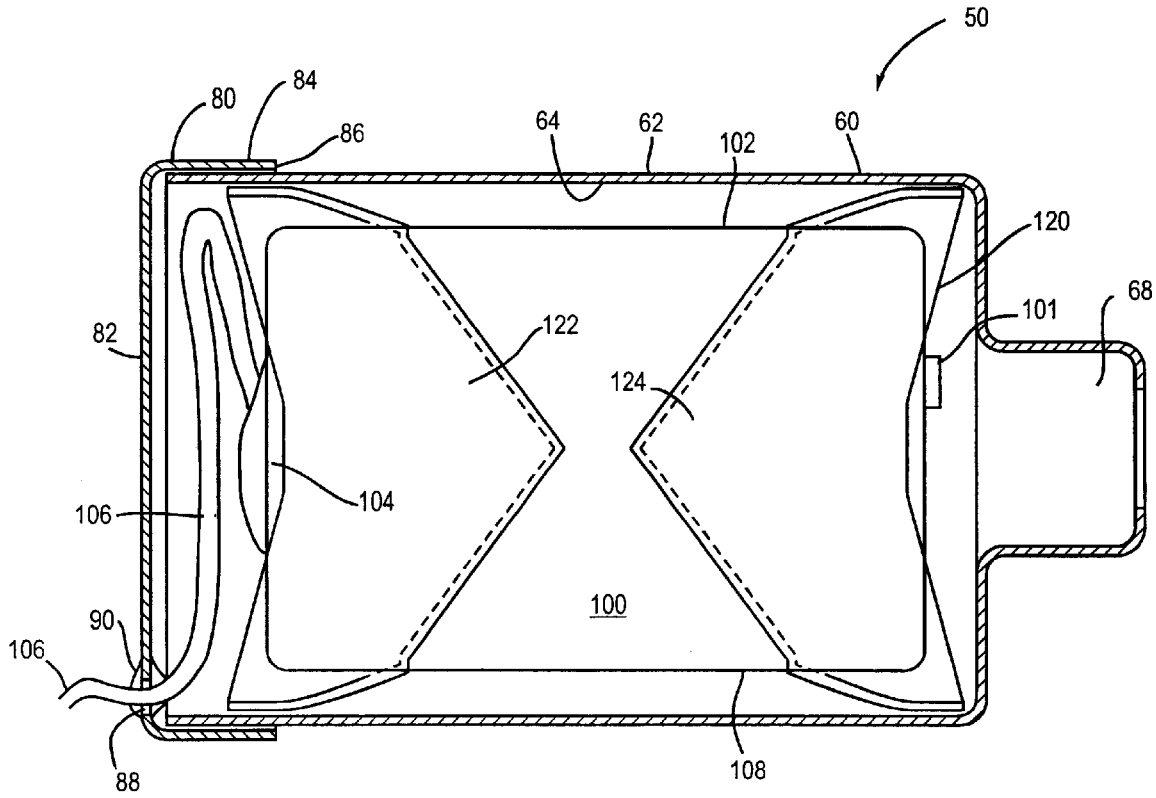
FIG. 3 is a longitudinal cross sectional view of an assembled receiver suspension constructed in accordance with the present invention.

FIGS. 1–3 show a hearing device receiver suspension 50 constructed in accordance with the present invention. In the embodiment of FIGS. 1–3, the receiver suspension 50 has a rigid housing 60 that includes an open proximal end 61 and a distal end 63. The housing 60 includes a sound port 68 extending from the distal end 63. Preferably, the housing 60 is cylindrically shaped and has an inside surface 64 that defines a chamber 70, and an outside surface 66. The housing 60 is preferably formed from a strong metal that allows a thin wall construction without sacrificing strength or rigidity. Such a construction allows the thickness of a wall 62 of the housing to be minimized. Particularly in CIC hearing devices, it is often critical to try and minimize the size of the hearing device components.

When fully assembled (best seen in FIG. 3), the proximal end 61 of the housing 60 is closed by an end cap 80. The end cap 80 is adapted to securely engage with the proximal end 61 of the housing 60. The end cap 80 has a proximal surface 82 that includes an aperture 88. When the end cap 80 is engaged with the housing 60, the aperture 88 provides access to the chamber 70. Preferably, the end cap 80 forms a sleeved interference fit with the proximal end 61 of the housing 60 so that it will independently remain in place. A glue, or other type of bio-compatible sealant 86 may also be used to more permanently attach the end cap 80 to the housing 60. The sealant 86 may also be used to seal the chamber 70 from the outside environment in order to prevent contaminates such as water, oil, or debris from entering the chamber 70.

An isolation membrane 120 at least partially surrounds a hearing device receiver 100. Preferably, the isolation membrane 120 is formed from a stretched polymer that forms a series of pleats 122 and 124 when it is stretched around the receiver 100. The assembled receiver 100 and isolation membrane 120 are inserted into the chamber 70 defined by the housing 60. The series of pleats 122 and 124 run substantially perpendicular to a longitudinal axis of the isolation membrane and allow the receiver 100 to be suspended within the chamber 70. The pleats 122 and 124 require only a small contact area between the isolation membrane 120 and the inside surface 64 of the housing 60 in order to suspend the receiver 100 within the housing 60. When surrounded by the isolation membrane 120, the receiver 100 itself does not directly contact the inside surface 64 of the housing 60.

FIGS. 1 and 3 show the isolation membrane 120 with the pleats 122 folding away from the central opening in the isolation membrane 120. At rest, the isolation membrane 120 is a flat planar object with a central opening that can be formed by cutting two slits that form an X through the center of the isolation membrane 120. The slits form pleats 122 (or 124) that lie parallel to the opening when the isolation membrane 120 is at rest. But as shown in FIGS. 1 and 3, the pleats fold away from the opening when a receiver 100 is inserted through the opening in the isolation membrane 120.

While FIGS. 1–3 show a series of two pleats 122 and 124 formed by the isolation membrane 120, it is contemplated that there may be a fewer or a greater number of these pleats depending on the precise material chosen to form the isolation membrane 120, the configuration of the isolation membrane, and the degree to which the isolation membrane is stretched around the receiver 100. A larger number of pleats necessarily means that a larger contact area is maintained between the isolation membrane 120 and the inside surface 64 of the housing 60 but may result in a more stable suspension system.

Since the isolation membrane 120 is preferably formed from a polymeric membrane material such as polyurethane or silicone, its thickness can be reduced to between 0.001 and 0.003 inches. This is a significantly reduced thickness as opposed to the use of known molded rubber suspensions which have a wall thickness between 0.007 and 0.010 inches. Known rubber molding processes do not permit the small thicknesses that can be achieved with the use of a membrane type material. Since reducing the size of the individual hearing device components is crucial in the design and production of CIC hearing devices, reducing the size of the isolation membrane 120 allows the housing 60 and the entire hearing device to be smaller as well.

The sound port 68 that extends from the distal end of the housing 60 aligns with a speaker 101 that is incorporated into the receiver 100. Known hearing device receivers that incorporate a sound port directly onto the receiver require that the sound port directly engage with an aperture on the hearing device shell. This direct contact between the receiver and the hearing device shell can compound the undesired effects of vibrational feedback. A receiver suspension constructed in accordance with the present invention incorporates the sound port 68 onto the housing 60, thereby eliminating the need to incorporate the sound port directly on the receiver. This results in fewer of the receiver components being in direct contact with the housing 60 and therefore a hearing device shell, aiding in the overall reduction of vibrational feedback.

The sound port 68 located on the distal end of the receiver housing 60 funnels the acoustic energy produced by the receiver 60 and directs it toward a user's inner ear and eventually the tympanic membrane (ear drum). Rather than a portion of the receiver itself being inserted through an aperture on a hearing device shell, the sound port 68 on the housing 60 can instead be inserted through the same aperture. This further isolates the receiver 60 from the other portions of the hearing device, the only contact between these elements being the portions of the isolation membrane pleats 122 and 124 that suspend the receiver 100 within the chamber 70.

Prior to inserting the receiver 100 into a hearing device shell, the receiver 100 is pre-suspended within the receiver housing 60 and the entire assembly can be inserted as a module into the hearing device shell. The size of the housing 60 can therefore be standardized for use in a variety of hearing device shells because the isolation membrane can account for any extra space between the housing 60 and the receiver 100. Various receivers 100 can also be utilized with a single sized housing 60 by providing differently sized isolation membranes 120.

The receiver 100 also includes contact pads 104 on its distal end that enable wires 106 to be connected to the receiver 100. The wires 106 are then threaded through the aperture 88 formed through the end cap 80, and are routed to the various electronics located within the hearing device. For example, the wires may lead to an integrated sound processing circuit. Any gaps left between the aperture 88 and the wires 106 are filled with a sealant 90 to ensure that the receiver continues to be protected from dirt, moisture and other contaminates and to prevent sound leakage.

Figure 4:
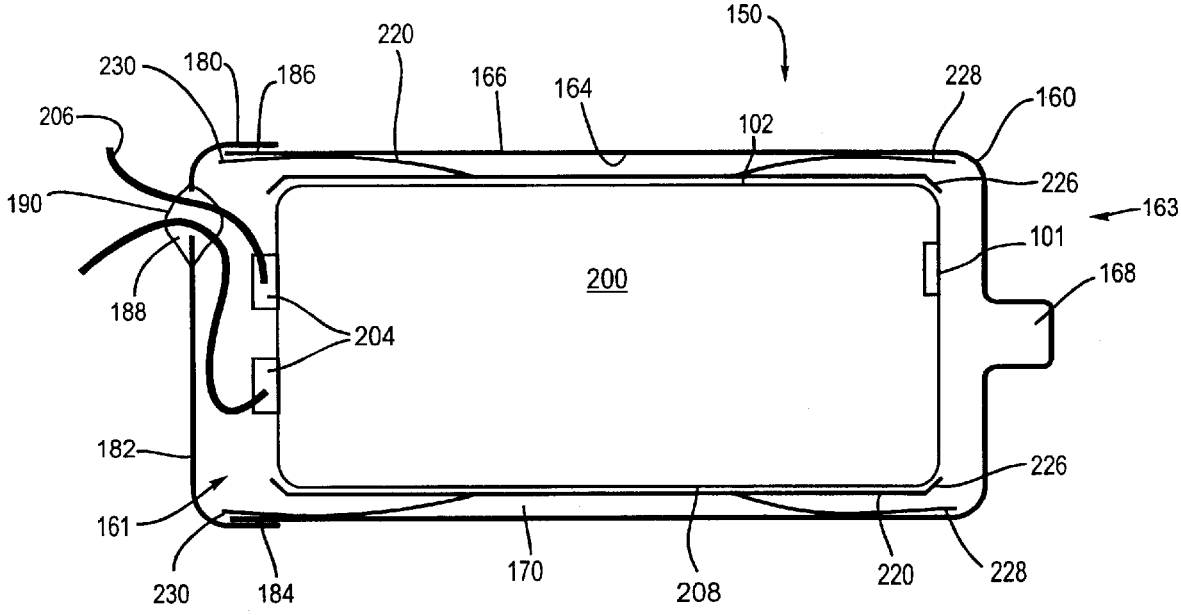
FIG. 4 is a longitudinal cross sectional view of an alternate embodiment of an assembled receiver suspension constructed in accordance with the present invention.

FIG. 4 shows a further preferred embodiment of a hearing device receiver suspension 150 constructed in accordance with the present invention. The receiver suspension 150 has a rigid housing 160 that has an open proximal end 161 and a distal end 163. The housing 160 also includes a sound port 168 extending from the distal end 163. Preferably, the housing 160 is cylindrically shaped with an inside surface 164 that defines a chamber 170, and an outside surface 166. The housing 160 is formed from a strong metal that allows a thin wall construction without sacrificing strength or rigidity. The utilization of such a material for the housing 160 allows the thickness of a wall 162 to be minimized. Particularly in CIC devices, it is critical to minimize the size of the various components.

When fully assembled, the proximal end 161 of the housing 160 is closed by an end cap 180. The end cap 180 is adapted to securely engage with the proximal end 161 of the housing 160. The end cap 180 has a proximal surface 182 that includes an aperture 188. When the end cap 180 is engaged with the housing 160, the aperture 188 extends through the proximal surface 182 of the end cap 180 and into the chamber 170. Preferably, the end cap 180 forms a sleeved interference fit with the proximal end 161 of the housing 160 so that it will independently remain in place. A glue, or other type of bio-compatible sealant 186 may also be used to more permanently attach the end cap 180 to the housing 160. The sealant 186 may also be used to seal the chamber 170 from the outside environment in order to prevent contaminates such as water, oil, or debris from entering the chamber 170. A receiver 200 includes contact pads 204 on its distal end that enable wires 206 to be connected to the receiver 200. The wires 206 are then threaded through the aperture 188 formed through the end cap 180 and are routed to the various electronics located within the hearing device. For example, the wires may lead to an integrated sound processing circuit. Any gaps left between the aperture 188 and the wires 206 are filled with a sealant 190 to ensure that the receiver continues to be protected from dirt, moisture and other contaminates.

A pair of isolation springs 220 are inserted between the receiver 200 and the inside wall 164 of the housing 160. The isolation springs 220 suspend the receiver 200 within the chamber 170 so that only a minimum amount of contact is maintained between the isolation springs 220 and the inside wall 164 of the housing. No part of the receiver 200 directly contacts the inside wall 164 of the housing 160.

Figure 5:
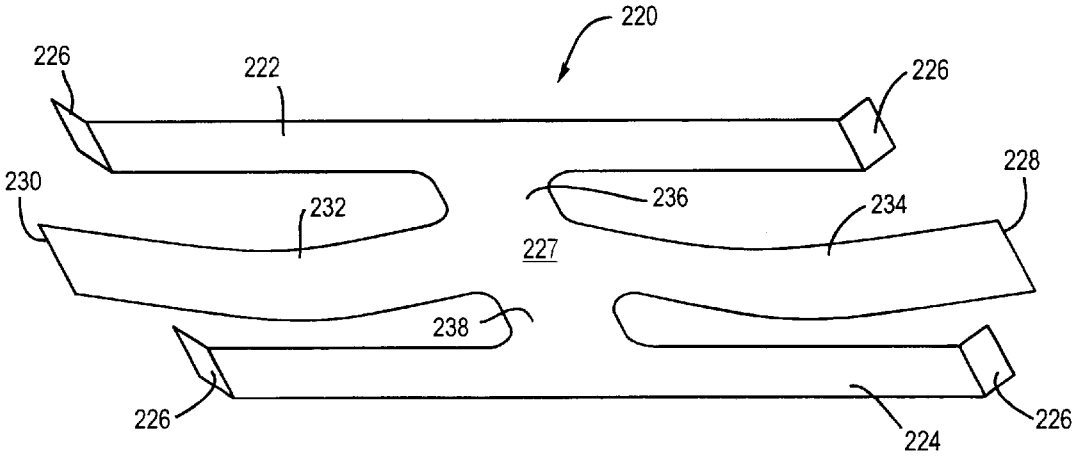
FIG. 5 is a perspective view of a receiver suspension isolation member constructed in accordance with the present invention.

Referring to FIG. 5, the isolation springs 220 are shown in greater detail. Each of the isolation springs 220 includes a first grasping member 222, a second grasping member 224, and a flexure member 227. The flexure member 227 is disposed in between the first and second grasping members 222 and 224 with each of the grasping members 222 and 224 being offset from the flexure member 227 by a substantially equal distance. Each of the two grasping members 222 and 224 and the flexure member 227 are aligned substantially parallel to each other and are connected by a pair of cross members 236 and 238. Each of the grasping members 222 and 224 are substantially flat and lie in a substantially common plane. Each of the grasping members 222 and 224 has a first end and a second end, each of the ends including a flange 226 extending from the surface of the respective grasping member. Each of the flanges 226 extend away from the surface of the grasping members in a common direction.

The flexure member 227 includes a first spring biased portion 232 and a second spring biased portion 234. The flexure member 227, and more specifically the two spring biased portions 232 and 234 enable the isolation springs 220 to suspend a receiver within a receiver housing, while also securing the receiver in place. As shown in FIG. 4, each isolation spring 220 is attached to the receiver 200 with the flanges 226 directed toward the receiver 200. The length of the grasping members 222 and 224 are such that the flanges 226 extend over the proximal and distal edges of the receiver and therefore hold the receiver 200 in place. The lengths of the grasping members 222 and 224 are substantially parallel to the receiver 200. The flexure member 227 is biased in a direction opposite to the direction that the flanges 226 extend. As best illustrated in FIG. 4, when a receiver 200 is inserted into a housing 160 with the pair of isolation springs 220 attached to it, the flexure members 227 exert a force on the inside surface 164 of the housing 160. The force exerted by the flexure members simultaneously cause each of the grasping members 222 and 224 to exert an opposite force against a top surface 202 and a bottom surface 208 of the receiver 200. The isolation springs 220, thereby suspend the receiver 200 within the chamber 170 defined by the housing 160.

Each of the flexure members 227 have a pair of contact surfaces 228 and 230 located at each of the opposite extremities of the flexure member 227. The contact surfaces 228 and 230 are the only portions of the flexure member 227 and of the entire isolation spring 220 that maintains contact with the inside surface 164 of the housing 160 when the receiver 200 and the isolation spring 220 are engaged and inserted into the housing 160.

The isolation spring 220 is preferably made from a thin easily controlled material such as a metal alloy or a thin formed polymer film. The material can also be formed by a chemical etching, electroforming, laser cutting, plasma etching, plasma deposition or other suitable means. The spring biasing of the suspension member, and more specifically the flexure member 227, interfaces with the housing 160 and the receiver 200 in a controlled and tuned manner that is capable of being adapted to the specific frequency range of the hearing device being used. The thickness, material properties, and geometry of the flexure member 227 is preferably selected to best isolate the receiver, in light of the frequency range of the hearing device, the mass of the receiver 200, and the mass of the hearing device (i.e. the shell structure and associated conformal tip). Preferably, the isolation member will have a low resonant frequency so that the higher frequency components are isolated and will not conduct vibrational energy back to the microphone.

Figure 6:
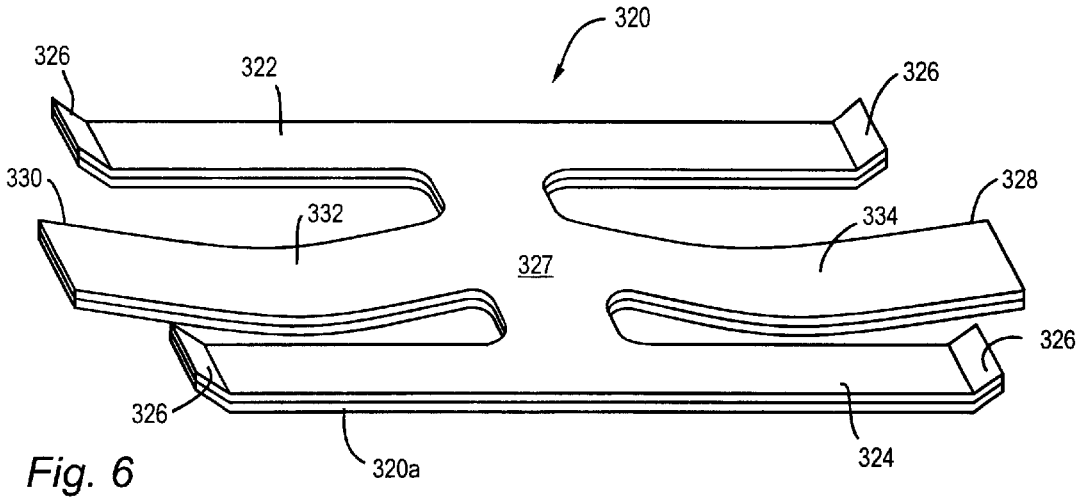
FIG. 6 is an alternate embodiment of a receiver suspension isolation member constructed in accordance with the present invention.

FIG. 6 shows an alternate embodiment of an isolation spring 320. The isolation spring 320 utilizes a controlled flexure suspension similar to the isolation spring 220 described in conjunction with FIG. 5, while additionally employing a multi-layer laminated structure. The isolation spring 320 includes the same geometric components as the isolation spring 220, namely, a pair of grasping members 322 and 324 and a single flexure member 327. The orientation of the flexure member in relation to the grasping members is similar to that of the isolation spring 220 of FIG. 5. The isolation spring 320 also includes flanges 326 located on each of the ends of the grasping members 322 and 324. A second isolation spring layer 320-*a* is bonded to the main layer to form the multi-layer structure. Further layers may be utilized in order to achieve a flexure with specific frequency response characteristics.

The laminate multi-layer structure of FIG. 6 is specifically designed to maintain the low frequency suspension and to additionally add a constrained or viscous type construction in order to dampen and absorb energy stored in the isolation spring, and more specifically, the flexure members. The laminated multi-layer structure can be fabricated as a thin metal sheet coated on one or both sides by a polymer layer. Preferably, the polymer layer has a viscous or lossy nature, and acts to absorb energy. The polymer layers can be coated in place, as is commonly done using conformal coatings on printed circuit boards. Materials that would have vibration dissipation properties of varying degrees include, but are not limited to: silicones, polyurethanes, epoxies, and acrylic materials. Alternately, the base structure of the flexure member can be laminated prior to forming using a mylar material. The polymer can be heat laminated with a bondable material such as a urethane film or the dampening layer can be applied by vapor deposition or another type of tin film deposition process.

Figure 7:
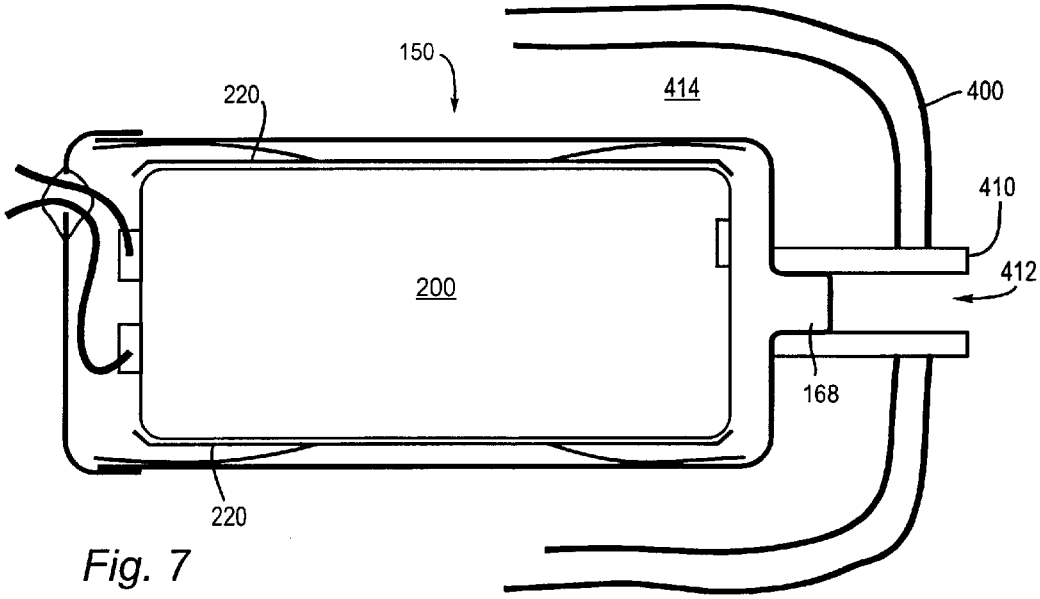
FIG. 7 is a first embodiment showing a receiver suspension constructed in accordance with the present invention mounted within a hearing device shell.
Figure 8:
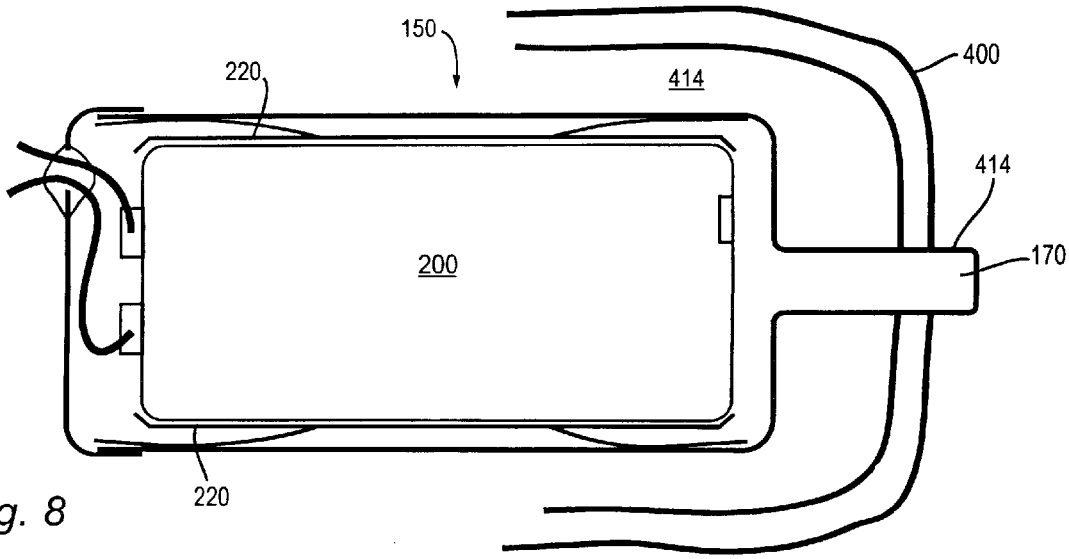
FIG. 8 is a second embodiment showing a receiver suspension constructed in accordance with the present invention mounted within a hearing device shell.

FIGS. 7 and 8 show two alternate embodiments of a receiver suspension and more specifically, the mounting schemes for attaching the receiver suspension to a hearing device shell. FIG. 7 shows a receiver housing 150 as described in conjunction with FIG. 4. The receiver housing 150 is shown as it would engage within a hearing device shell 400. The hearing device shell 400 includes an aperture 412 on its distal end, and an extension tube 410 that extends through the aperture 412 and into a chamber 414 defined by the hearing device shell 400. The sound port 168 on the distal end of the receiver housing is adapted to engage with the extension tube 410. Sound that is created by the receiver will thus be directed out of the sound port 168 through the extension tube 410 and out of the aperture 412. The aperture 412 is aligned on the distal end of the hearing device shell 400 so that when the hearing device is inserted into a user's ear canal, the aperture will align with and direct the sound waves generated by the hearing device directly toward the tympanic membrane (ear drum). The extension tube also helps to suspend the receiver suspension 150, and thus the receiver 200, within the chamber 414, providing further isolation to the receiver. U.S. patent application Ser. No. 09/467,102, filed on Dec. 10, 1999, describes a preferred embodiment of a receiver suspension that utilizes a grommet to suspend the receiver within the hearing device shell, the details of which are hereby incorporated into the present application by reference.

FIG. 8 shows the receiver suspension 150 including an integrated extended sound port 170. The hearing device shell 400 includes an aperture 414 through which the extended sound port 170 can engage. The embodiment of FIG. 8 eliminates the need for the additional extension tube 410 described in conjunction with FIG. 7. The extended sound port 170 engaged within the aperture 414 suspends the receiver housing 150 within the chamber 414 thus providing further isolation to the receiver housing 150 and thus the receiver 200.

Although the invention has been described and illustrated in the above description and drawings, it is understood that this description is by example only and that numerous changes and modifications can be made by those skilled in the art without departing from the true spirit and scope of the invention. The invention, therefore, is not to be restricted, except by the following claims and their equivalents.

What is claimed is:

1. A receiver suspension for isolating a hearing device receiver within a hearing device shell, comprising:

a housing having an inside surface that defines a chamber, an open proximal end, and a distal end;

a cover adapted to engage with the proximal end of the housing; and an isolation membrane, the isolation membrane at least partially surrounding the hearing device receiver such that, upon insertion of the hearing device receiver into the housing, the isolation membrane suspends the receiver within the housing chamber and prevents contact between the receiver and the housing inside surface, wherein the isolation membrane has a first side, a second side, an opening through its center that is sized to stretch over substantially the entire receiver, and at least one pleat lying parallel with the opening, said pleat folding away from the opening when the receiver is inserted through the opening.

2. The receiver suspension of claim 1, further comprising a sound port on the distal end of the housing.

3. The receiver suspension of claim 1, wherein the cover substantially seals the open proximal end of the housing when engaged therewith.

4. The receiver suspension of claim 1, wherein the cover includes an aperture extending therethrough, wherein the aperture provides access to the housing chamber when the cover is engaged with the housing.

5. The receiver suspension of claim 1, wherein the isolation membrane is formed from polyurethane or silicon.

6. The receiver suspension of claim 1, wherein the isolation membrane maintains a minimum amount of contact with the housing inside surface.

* * * * *